United States Patent [19]

Wuthrich et al.

[11] Patent Number: 4,536,095

[45] Date of Patent: Aug. 20, 1985

[54] CROWN SETTING SWITCH FOR A WRISTWATCH

[75] Inventors: Paul Wuthrich; Lyman R. Daigle, both of Watertown; Anthony D. Daddona, Waterbury, all of Conn.

[73] Assignee: Timex Corporation, Waterbury, Conn.

[21] Appl. No.: 650,011

[22] Filed: Sep. 13, 1984

[51] Int. Cl.[3] ..... G04B 29/00

[52] U.S. Cl. ..... 368/321; 368/320; 368/314; 368/308

[58] Field of Search ..... 368/320, 321, 308, 290, 368/187, 190, 188

[56] References Cited

U.S. PATENT DOCUMENTS

| | | | |
|---|---|---|---|
| 3,733,803 | 5/1973 | Hiraga et al. | 58/23 R |
| 3,877,217 | 4/1975 | Hochstrate | 368/320 |
| 4,135,359 | 1/1979 | Yajima | 368/190 |
| 4,209,976 | 7/1980 | Flumm | 368/190 |
| 4,319,351 | 3/1982 | Fujimori et al. | 368/187 |
| 4,400,095 | 8/1983 | Namyslo | 368/320 |
| 4,415,277 | 11/1983 | Ganter | 368/190 |

FOREIGN PATENT DOCUMENTS

| | | |
|---|---|---|
| 1022275 | 6/1977 | Japan . |
| 1002666 | 6/1977 | Japan . |
| 1005171 | 9/1977 | Japan . |
| 1518769 | 7/1978 | United Kingdom . |

*Primary Examiner*—Bernard Roskoski

*Attorney, Agent, or Firm*—William C. Crutcher

[57] ABSTRACT

A crown switch actuator in a solid state analog wristwatch rotates in either direction and is movable axially. The actuator stem has a flat portion which rotatably operates a rocker contact spring against contact pads on a printed circuit board to alternately close first and second switches. The rocker contact spring also detents the switch actuator in one of two axial positions and retains the crown actuator in the watch case. Third and fourth switches are alternately closed by axial movement of the crown actuator stem. In a first detented axial position, the third switch is closed. In a second detected axial position, the third and fourth switches are open. In a third axial position, the fourth switch is closed. An extension arm on the detent rocker contact spring provides for releasing the crown actuator from the watch case.

11 Claims, 5 Drawing Figures

CROWN SETTING SWITCH FOR A WRISTWATCH

BACKGROUND OF THE INVENTION

Briefly stated, this invention relates to a switch mechanism for a wristwatch, and more particularly to a crown setting switch for an analog wristwatch for setting the hands forward or backward or performing other switching functions in accordance with the axial and rotated position of the crown.

Wristwatches with conventional hands operated by a mechanical or electronic motor through a train of gears are usually set by a crown which is pulled out and rotated in clockwise or counterclockwise direction to move the hands forward or backward. Electronic watches often use internal switches operated by push-buttons in the case. Solid state analog watches with representations of mechanical hands through the use of liquid crystal or other types of displays are also known, which use internal switches actuated by external push buttons to "rotate" the displayed images representing hands. Suggestions have been made to simulate the familar setting of a conventional wristwatch with a crown by providing internal switching mechanisms actuated by rotating or axially moving a crown, for example as shown in British Specification No. 1,518,769 or in U.S. Pat. No. 4,209,976, the latter assigned to the present assignee.

Various types of push and/or rotate switching mechanisms have been devised, in which switches are actuated inside a watch case by either rotating or axially moving the actuator in a prescribed manner. The actuators are also usually provided with a seal to prevent entry of dust or water and yet to permit the actuator to operate. Examples of such switch actuators are shown in U.S. Pat. No. 3,874,162 issued Apr. 1, 1975 to Boxberger, et al, U.S. Pat. No. 4,023,002 issued May 10, 1977 to Wuthrich, et al and U.S. Pat. No. 4,031,341 issued June 21, 1977 to Wuthrich, et al. These switches all have sealed axially movable actuators which are rotatable to make switch contact closures and which employ spring retaining clips to hold the stem in place and to detent it in a single axial position. Axial movement is allowed by biasing a section of the retaining spring. Detent springs which hold the crown stem in two or more axial detented positions for engaging conventional watch gearing are also well known.

It is desirable in a watch to simplify the internal construction as much as possible by reducing the number of parts and making parts perform more than one function. One aspect of the present invention contemplates the use of contact pads on the watch printed circuit board to serve as contact switch terminals without need for additional parts. A similar use of contact pads on a printed circuit board in a rotary switch arrangement for a watch crown is shown in U.S. Pat. No. 3,733,803.

It is desirable to have a crown setting switch actuator with a minimum number of parts designed to effect closure of switches when the actuator is rotated in either direction and while in more than one axial position to operate different switches so that a number of functions can be accomplished. It would also be desirable to provide a crown switch actuator for a solid state analog watch which operates somewhat in the manner of a conventional time setting crown actuator to set the watch when the crown is pulled out and rotated in either direction to move the hands forward or backward.

Accordingly, one object of the present invention is to provide an improved crown setting switch actuator for a solid state analog watch.

Another object of the invention is to provide an improved crown switch actuator for actuating a multiplicity of switches inside the watch using a minimum number of parts.

Still another object of the invention is to provide an improved crown switch actuator with switch contact elements which also perform other functions, such as holding the stem in the watch.

DRAWINGS

The invention, both as to organization and method of practice, together with further objects and advantages thereof, will best be understood by reference to the following description, taking in connection with the accompanying drawings, in which:

FIG. 1 is a top plan view of a solid state analog watch having a crown switch actuator, FIG. 2 is a side elevation drawing, partly in section, of a portion of the watch illustrating the crown switch actuator mechanism, the section being taken along lines II—II of FIG. 3, FIG. 3 is a top plan view, partly in section, of the portion of the watch illustrated in FIG. 2, FIG. 4 is an end elevation view illustrating the detent rocker contact spring, taken along section lines IV—IV of FIG. 2, and FIG. 5 is a schematic exploded perspective drawing of the components illustrating the method of operation.

SUMMARY OF THE INVENTION

Briefly stated, the invention is practiced by providing a rotatable, axially movable crown actuator with stem detent grooves cooperatively engaged with a detent rocker contact spring. The rocker spring is held in the watch case to prevent axial movement, but to permit limited rocking movement, and having a pair of opposed switch contact arms engageable with contact pads on the printed circuit board of the watch. The actuator stem is rotatable within the watch case, and has a flat section engaged with the detent rocker contact spring to cause it to rotate with the stem. The detent rocker contact spring has an extending arm which allows axial movement of the stem within the rocker spring and which also permits removal of the stem. The end of the stem engages a resilient axial contact spring which alternately engages one of two contact terminals attached to the printed circuit board.

DESCRIPTION OF THE PREFERRED EMBODIMENT

Figure 1:
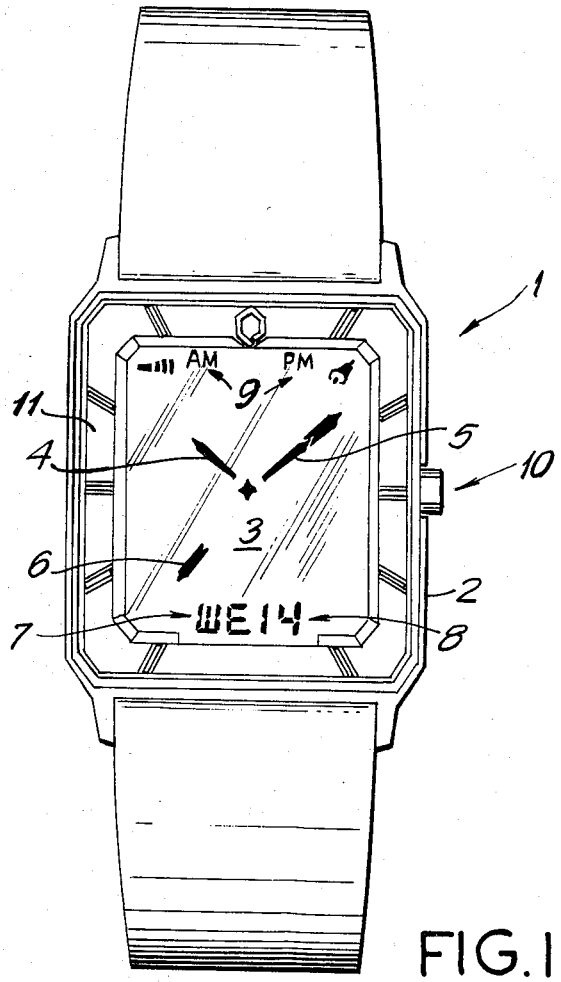

Referring now to FIG. 1 of the drawing, a solid state analog wristwatch shown generally at 1 includes a conventional case or bezel 2 enclosing a liquid crystal display 3 constructed in a known manner to provide an hour hand 4, a minute hand 5, and a seconds indicator 6 to display the time in analog fashion. Other indicia comprising alphanumeric, symbolic or digital characters may also be presented by the digital display such as a day-of-the-week indicator 7, date indicator 8, and alarm, chime and AM/PM symbols 9. The display is actuated by internal power source and timekeeping is controlled by electrical circuitry in a manner not material to the present invention. Setting of the time, alarm, day, date and other functions are performed in response to switch closures inside the watch.

In accordance with the present invention, solid state analog wristwatch 1 includes a crown setting and switch actuating mechanism shown generally as 10, which is used to set the watch by moving the hands 4, 5 forward or backward, as well as to perform other functions through the internal switches, such as setting or silencing the alarm, correcting the day and date, etc.

A time indicia frame 11 surrounding the display 3 may include markers to assist in telling the time. Examples of solid state analog wristwatches are shown in the following exemplary patents, such as the aforementioned British Specification No. 1,518,769; U.S. Pat. No. 3,959,963 to N. Murrell; U.S. Pat. No. 3,844,105 to Kashio; U.S. Pat. No. 3,540,209 to Zatsky, et al; U.S. Pat. No. 4,385,842 to Wiesner.

Figure 2:
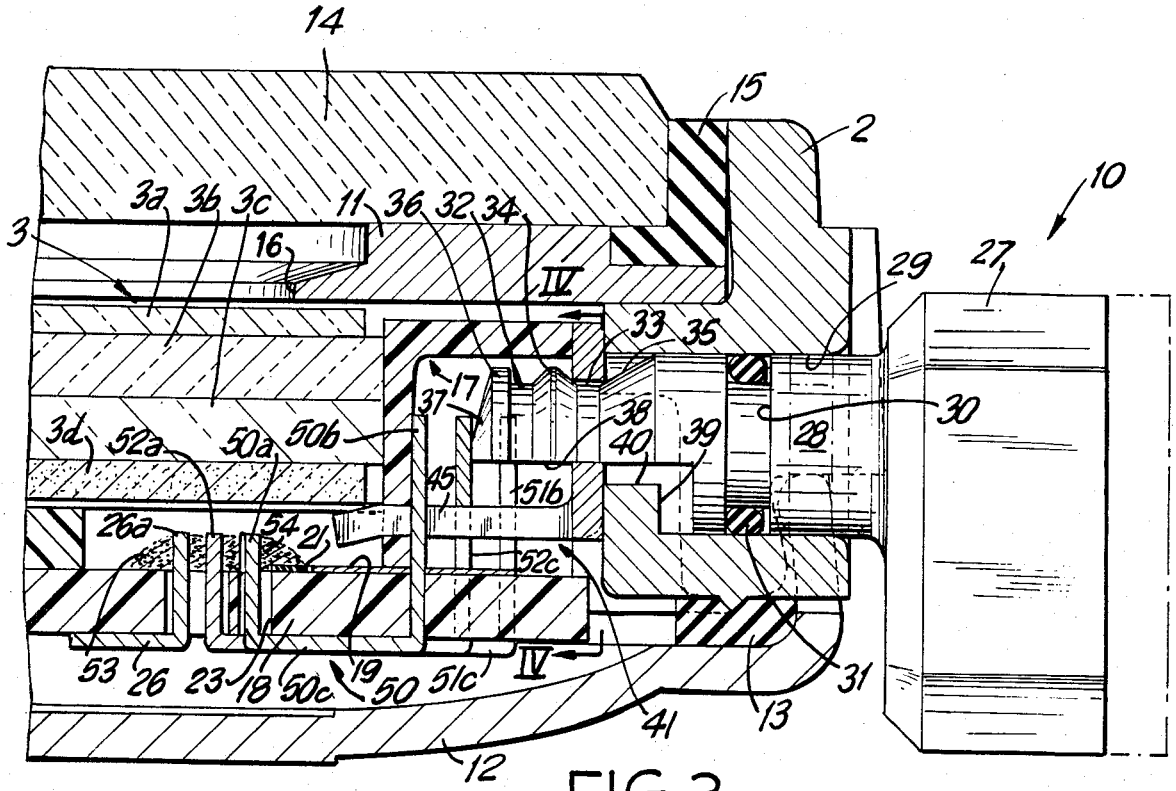

Referring now to FIG. 2 of the drawing, the conventional elements of the solid state analog watch, shown in cross section, are the bezel 2 adapted for attachment to a case back 12, with a seal 13 therebetween. A lens 14 is retained in, and sealed with respect to, bezel 2 by a lens gasket 15. The time indicia frame 11 is held on a ledge in the bezel and defines a central opening 16 to expose the liquid crystal display 3. The display may be of the twisted nematic field effect type, which includes a top polarizer sheet 3*a*, a top glass 3*b*, a bottom glass 3*c* and a polarizer/reflector combination 3*d*, the liquid crystal material between top and bottom glass being omitted from the drawing. The display is held within a plastic frame or pod, portions of which are shown at 17. The electronic components connected to the display 3 are carried on a printed circuit board 18, which includes connection pads and interconnecting leads connected to switching terminals on the integrated circuit (not shown).

Figure 3:
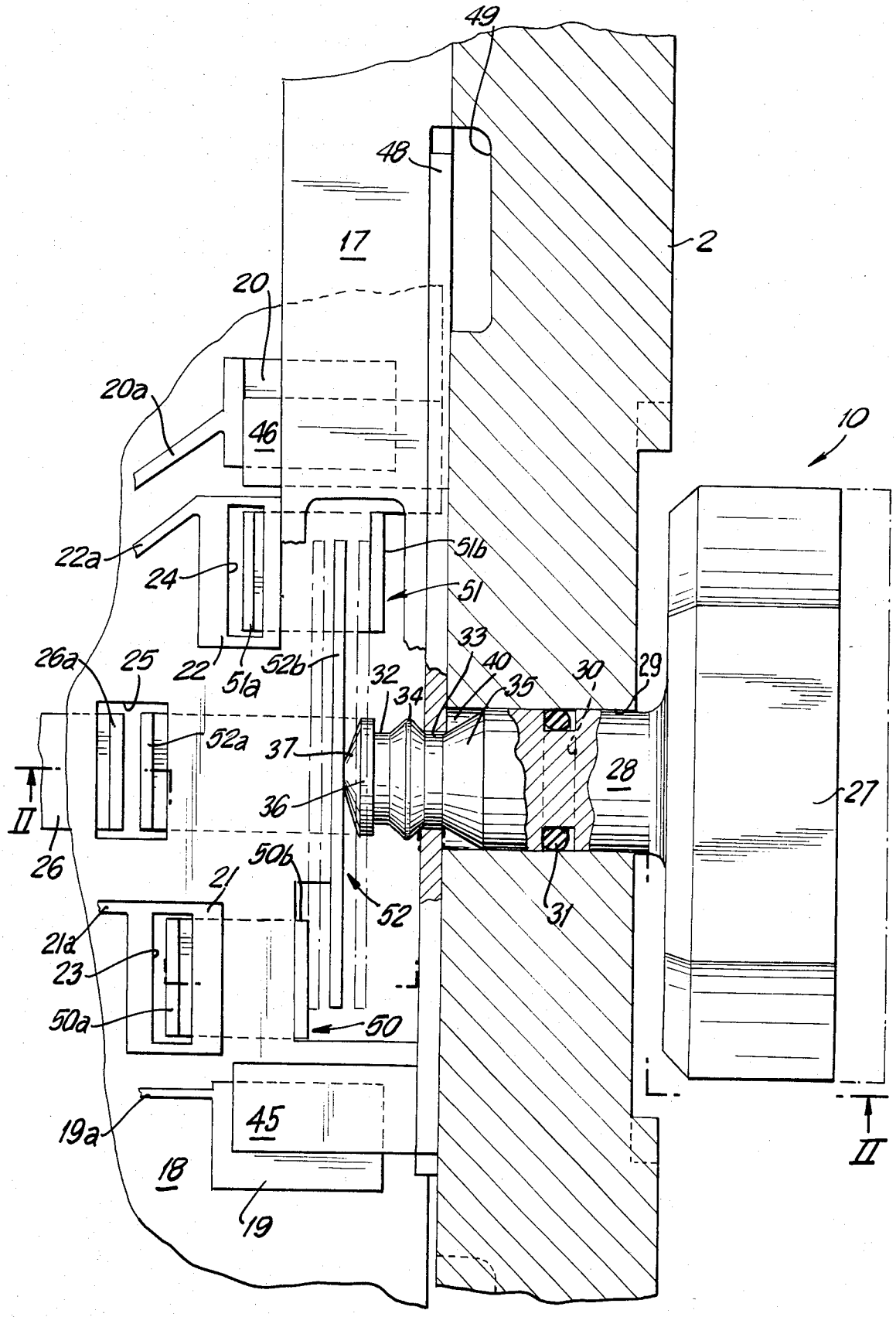

Reference to FIG. 3 of the drawing shows portions of the printed circuit board (or PCB) 18. First and second switching contact pads 19, 20 are deposited as layers of conducting material on the PCB and connected by leads 19*a*, 20*a* to switching terminals or pins of the integrated circuit. PCB 18 also includes switch contact terminal pads 21, 22 connected to the integrated circuit by leads 21*a*, 22*a*. Pads 21, 22 are pierced by openings 23, 24 which also extend through the thickness of the PCB 18. Another similar pierced opening 25 in the PCB accommodates an upturned leg 26*a* of a grounding plate extension 26 running underneath the PCB and connected to ground or common. The aforementioned types of electrical contact terminals comprise the three types of terminals used in the present invention, i.e. simple contact pads 19, 20; pierced contact pads 21, 22; and PCB openings enclosing a grounding conductor. The above elements of the solid state analog watch are all known in the art to which the present invention pertains.

The crown setting and switch actuating mechanism, which is the subject of the present invention, is now described in connection with FIGS. 2 and 3 of the drawing. Actuator 10 includes an external crown 27 and a crown stem 28 extending through a hole 29 in bezel 2 so as to be allowed to rotate and to slide axially to a limited extent therein. A circumferential groove 30 accommodates an O ring seal 31. Stem 28 defines a first detenting groove 32 and, a second detenting groove 33 separated by a sloped circumferential projection 34. Groove 33 is connected by a sloping surface 35 to the major portion of the stem housed in the hole 29. The stem end terminates in a flange 36 and switch actuating knob 37. A portion of the stem end is removed to provide a flat underside 38. Hole 29 in the bezel is not cylindrical throughout its entire length, but is provided with a wall 39 adjacent the inside the bezel with an upper flat surface 40. The wall surface 40 allows the stem to rotate only through a limited angle in either direction until the flat underside 38 of the stem contacts surface 40. The stem 28 is set off-center from top to bottom with respect to the center of crown 27 to lower the crown on the case for aesthetic purposes.

Figure 4:
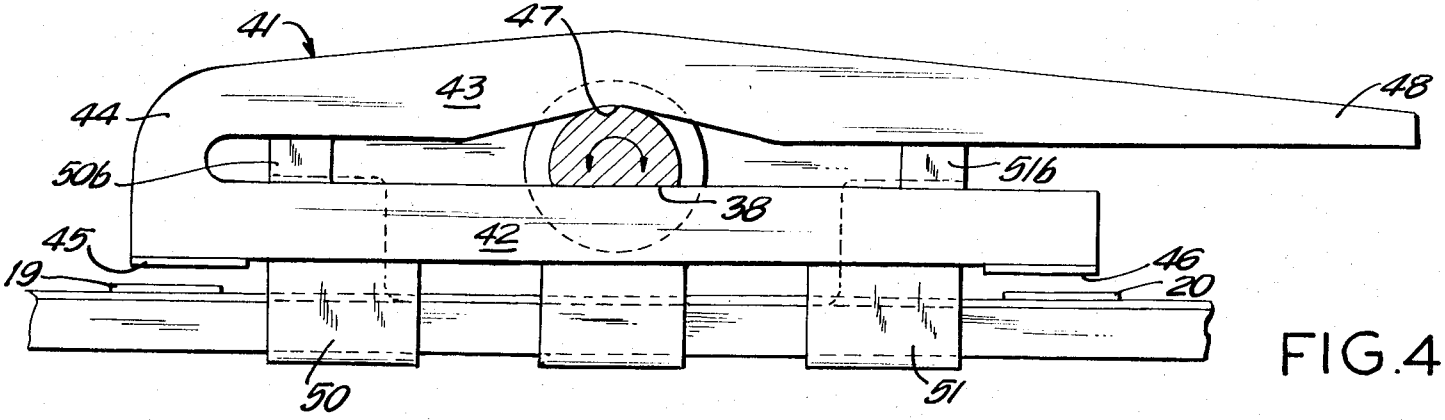

In accordance with the present invention, a detent rocker contact spring 41 is carried by the end of stem 28 and cooperates therewith in a manner to be described. The detent rocker contact spring 41 may best be understood by reference to FIG. 4 of the drawing and includes a lower arm 42 and an upper arm 43 spaced therefrom and connected by a spring portion 44 at one end. Lower arm 42 has integral switch contact arms 45, 46 extending at right angles therefrom on opposite ends with respect to the axis of stem 28. Arms 45, 46 are located in alignment with and spaced from PCB contact pads 19, 20 respectively. When arm 45 contacts pad 19 a first switch is provided; when arm 46 contacts pad 20 a second switch is provided.

The upper arm 43 of spring 41 includes a cam follower or detenting surface 47 adapted to ride in stem detenting grooves 32 or 33 by virtue of spring bias when the lower arm 42 is against the flat portion 38 of the stem. The upper arm 43 also includes a stem removal extending portion 48. A recess 49 in the bezel (FIG. 3) is disposed opposite the extension 48 and large enough to accommodate a small tool. The detent rocker contact spring 41 is restrained in its axial position between the plastic frame 17 and bezel 2. Suitable cavities in frame 17 are provided so that the spring 41 can rock when the stem is rotated through cooperation between the flat underside 38 of the stem and the lower arm 42 of the spring.

Third and fourth switches are provided to be actuated by the stem when it is moved in an axial direction. A pair of axially spaced, fixed switch contact terminals are provided by U shaped clips 50, 51. Clip 50 has an upstanding portion 50*a* extending through hole 23 in pad 21 on PCB 18, an upstanding portion 50*b* projecting above the PCB, and an underlying connecting portion 50*c*. Clip 51 includes corresponding elements 51*a*, 51*b*, 51*c*.

Electrical contact to the common grounding plate 26 is made when the stem moves axially against a central flexible axial contact spring 52. Spring 52 is a formed T-shaped clip with an upstanding end 52*a* disposed in PCB hole 25, an extending contact arm 52*b*, and an interconnecting flexible portion 52*c*. Arm 52*b* extends in the space between fixed contact terminals 50*b*, 51*b* and is spring biased so that when there is no axial pressure on it, it presses in contact with terminal 51*b*.

The axial contact spring 52 and the fixed contact terminals 50, 51 are electrically connected to the circuitry on the PCB by means of solder connections made to the respective upstanding tabs 50*a*, 51*a*, 52*a*, in a manner shown by reference to FIG. 2. For example, ends 26*a*, 52*a* are electrically connected by means of a solder joint 53 while ends 50*a*, 51*a* of the fixed clips are held in place and electrically connected to PCB pads 21, 22 by means of solder connections such as 54.

Figure 5:
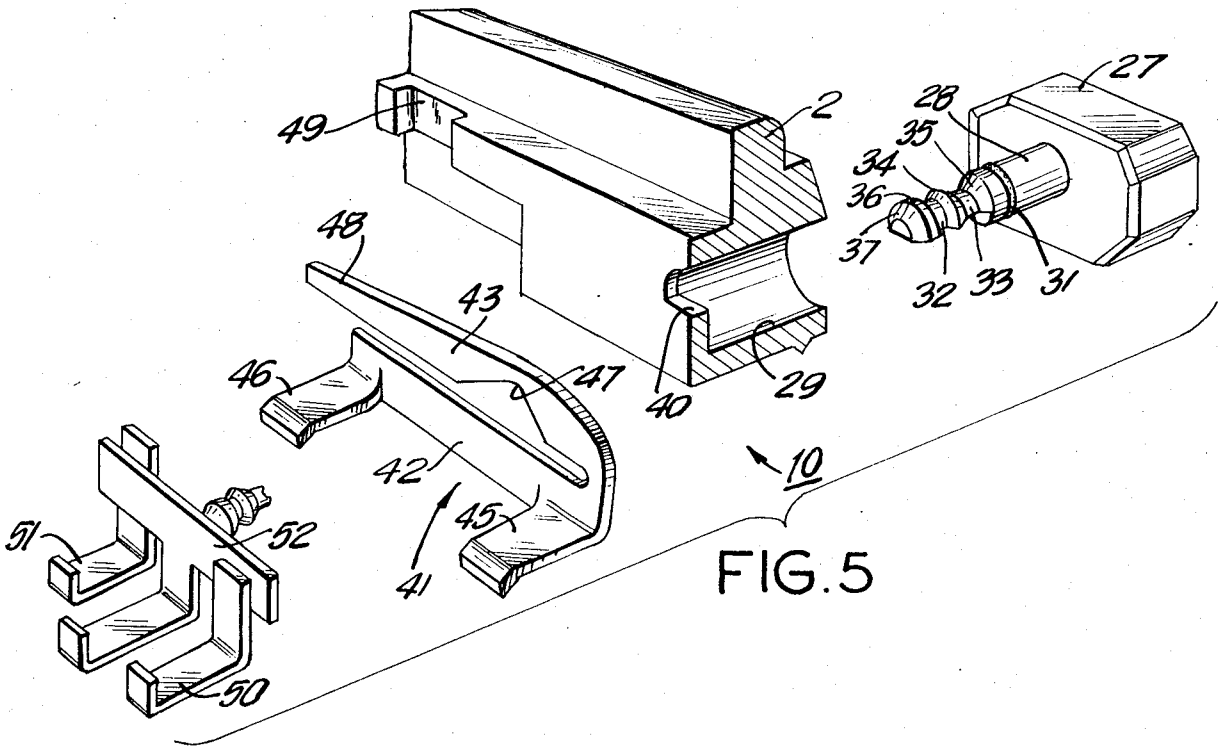

FIG. 5 illustrates an exploded simplified perspective view of the elements of the crown setting actuator and switching mechanism 10. When the detent rocker contact spring 41 is retained in axial position with respect to bezel 2, the stem can be inserted or removed through the use of a small tool by placing it in hole 49 in the bezel raising the extension 48 to spread arms 42, 43 apart, so as to permit insertion or removal of the stem 28. The resiliency of spring 41 also permits axial movement and detenting of the stem into either of the detent grooves 32, 33, as well as providing for pushing the crown inward beyond detenting groove 33. This is accommodated by means of the sloping surface 35 on the stem (FIG. 2).

OPERATION

The operation of the invention will be understood by reference to the drawings in FIGS. 2–5. The stem 28 is shown in a first axial detenting position, held axially in place by spring bias of the upper arm 43 into detent groove 33 of the stem. In this position, switching arm **52*b* is biased in the position shown away from its spring contact with fixed contact terminal 51. When the crown is rotated clockwise or counterclockwise, the contact arms 45, 46 make contact directly with the contact tabs 19, 20** on the PCB. The circuitry is connected such that no switching function is performed, since such rotation could occur inadvertently while wearing the wristwatch.

When the crown is pushed in against the detenting bias provided by the resiliency of arm 43 riding on sloping surface 35, the axial contact spring 52 makes contact with fixed terminal 50. The electrical circuitry is such that this will stop the alarm on the wristwatch if it is sounding.

If, while the crown is in the inward detent position, it is rotated clockwise or counterclockwise within a prescribed time (for example, within four seconds after it is pushed in), switch contacts are made between arm 45 and pad 19 or between arm 46 and pad 20. The circuitry is connected such that the watch hands are rotated either clockwise or counterclockwise to change the time of setting for the alarm.

Pulling the stem out causes the detent arm to hold the stem in a second detenting position in detent groove 32. In this position, the axial contact spring 52 is biased against fixed clip 51, which places the wristwatch in a time setting mode. Rotation of the crown clockwise or counterclockwise causes the respective contact arms 45, 46 to make contact with pads 19, 20. This closes first and second switches to move the watch hands respectively first backward or forward to a new time setting. The crown is returned to the previous first detent position by pushing it back to the normal position shown in the drawings.

While the preferred embodiment uses two contact arms on either side of the stem axis, it is within the scope of the invention to employ a single contact arm having a pair of contact terminals spaced above and below the arm to provide first and second switches when the stem is rotated in opposite directions. Modification in such a way would be obvious to one skilled in the art.

While the functions performed by the crown setting actuator and switching mechanism are described in connection with particular circuit connections, these are not material to the present invention, since the switch mechanism could also perform other functions such as setting the day of the week or calendar date forward or backward. Additional detenting positions and additional axial switch positions could also be added as should be apparent to those skilled in the art.

The objectives of the invention in providing a simple switching mechanism are achieved through the use of a detent rocker contact spring which makes switch contact directly with pads on the PCB board, which holds the stem in various axial detent positions, which has provision for removal of the stem from the watch, and which biases the stem to prescribed rest positions, while allowing axial movement against the spring. Damage to the mechanism is avoided by means of the limited degree of rotation provided by the wall 40 which positively prevents rotation of the stem beyond a certain point. Simplified connections of the axial switch contact clips to the PCB through soldered connections allow axial switch contacts to be made with a simplified construction.

While there has been described what is considered to be the preferred embodiment of the invention, other modifications will occur to those skilled in the art, and it is desired to secure in the appended claims all such modifications as fall within the true spirit and scope of the invention.

We claim:

1. In a timepiece having a bezel, a time display, circuit means providing timekeeping and displaying time on the time display, and a plurality of internal switch terminals connected to said circuit means for performing switching functions including time setting, the improvement comprising:

an external crown, a crown stem attached thereto and extending through an opening in said bezel, said stem defining a plurality of axially spaced detenting grooves, said stem being axially slidable and rotatable about an axis, a detent rocker contact spring having a spring arm biased into said grooves, means cooperating with said stem to constrain said spring to rotate therewith, and at least one switch contact arm spaced from the stem rotation axis, means restraining said detent rocker contact spring against axial movement with respect to the bezel, whereby detenting takes place when the crown is pushed or pulled, and first and second switching contact pads connected to selected switch terminals, at least one of said contact pads being aligned with and circumferentially spaced from said switch contact arm to be contacted thereby to provide a switching function when the stem is rotated while the stem is in any detenting position.

2. The improvement according to claim 1, wherein there are a pair of switch contact arms on said detent rocker contact spring disposed on opposite sides of the stem rotation axis, and wherein said first and second contact pads are respectively aligned with and circumferentially spaced from the switch contact arms to be alternately contacted thereby to provide first and second switches when the stem is rotated.

3. The improvement according to claim 1, further including a third switch adapted to be actuated by the axial movement of the crown stem into one of said detenting positions, whereby the third switch is closed while permitting closure of either the first or second switch by rotating the crown.

4. The improvement according to claim 1, further including a fourth switch adapted to be closed by axial movement of said crown beyond one of said detenting positions against the bias of said spring arm, whereby the fourth switch is closed while permitting closure of either the first or second switch by rotating the crown.

5. The improvement according to claim 1 and further including third and fourth switches adapted to be actuated by axial movement of said stem, wherein said third and fourth switches include a pair of axially spaced fixed switch contacts, and a flexible axially movable contact spring contacting said stem and arranged to alternately contact either of said fixed switch contacts when the stem is moved in an axial direction.

6. The improvement according to claim 4, wherein said timekeeping circuit means is at least partially implemented on a printed circuit board and wherein said fixed switch contacts comprise U-shaped clips having first upstanding ends connected to switching terminals on the printed circuit board and second upstanding ends forming said spaced fixed switch contacts.

7. The improvement according to claim 1, wherein said stem includes a flat portion beneath a detent groove and wherein said rocker spring includes an arm opposite said spring arm in contact with the stem flat portion, constraining the rocker spring to rotate with the stem.

8. The improvement according to claim 1, wherein said means restraining said detent rocker spring comprises a frame between said time display and said bezel.

9. The improvement according to claim 1, wherein said timepiece circuit means is at least partially implemented on a printed circuit board, said first and second switching contact pads being disposed as layers of conductive material directly on said printed circuit board.

10. The improvement according to claim 1, wherein the spring arm of said rocker spring extends adjacent an opening defined in said bezel, and is adapted for releasing the stem by biasing the spring arm out of said detent grooves with a tool in the bezel opening.

11. In a timepiece having a bezel, a time display, circuit means providing timekeeping and displaying time on the time display, and a plurality of internal switch terminals connected to said circuit means for performing switching functions including timesetting, the improvement comprising:

an external crown, a crown stem attached thereto and extending through an opening in said bezel, said stem defining a plurality of axially spaced detenting grooves, said stem being axially slidable and rotatable about an axis, and defining a flat portion opposite said detenting grooves, a frame member disposed between the time display means and the bezel, a detent rocker contact spring having a lower arm adjacent the stem flat portion and an upper spaced spring arm biased into said grooves, and also having a pair of switch contact arms disposed on opposite sides of the stem rotation axis, said rocker spring being restrained against axial movement by said frame member, a printed circuit board having first, second, third and fourth contact pads deposited as layers thereon connected to selected switch terminals, said first and second pads being aligned with and spaced from said spring contact arms to be alternately contacting thereby to provide first and second switches when the stem is rotated, a pair of axially spaced fixed switch contacts comprising clips connected to said third and fourth pads, a flexible axially movable contact spring contacting the stem and arranged to alternately contact said fixed switch contacts when the stem is moved in an axial direction, whereby third and fourth switches are provided.

* * * * *